US006938308B2

(12) United States Patent
Funk

(10) Patent No.: US 6,938,308 B2
(45) Date of Patent: Sep. 6, 2005

(54) LACE SECURING AND ADJUSTING DEVICE

(76) Inventor: Douglas P. Funk, 1293 NW. Wall St., #113, Bend, OR (US) 97701

( * ) Notice: Subject to any disclaimer, the term of this patent is extended or adjusted under 35 U.S.C. 154(b) by 0 days.

(21) Appl. No.: 10/603,380

(22) Filed: Jun. 24, 2003

(65) Prior Publication Data

US 2004/0261235 A1 Dec. 30, 2004

(51) Int. Cl.[7] ..... A43C 7/00

(52) U.S. Cl. ..... 24/712.9; 24/712.5; 24/200; 24/130

(58) Field of Search ..... 24/18, 129 R, 24/130, 129 B, 115 R, 570, 30.5 R, 30.5 S, 68 F, 71.1, 713.2, 712.1, 712.2, 712.4, 712.9; 36/50.1

(56) References Cited

U.S. PATENT DOCUMENTS

| | | | | | |
|---|---|---|---|---|---|
| 441,732 | A | * | 12/1890 | Wilson et al. | 24/200 |
| 656,431 | A | * | 8/1900 | Stewart | 24/130 |
| 679,930 | A | * | 8/1901 | Webster | 24/130 |
| 749,847 | A | * | 1/1904 | Curtis | 24/130 |
| 858,555 | A | * | 7/1907 | Altick | 24/129 B |
| 1,050,771 | A | * | 1/1913 | Leupold | 24/130 |
| 1,225,623 | A | * | 5/1917 | de Kingsley Hall et al. | 24/129 R |
| 1,531,410 | A | | 3/1925 | Osterholt | |
| 1,639,226 | A | * | 8/1927 | Haines | 24/715.4 |
| 1,806,162 | A | * | 5/1931 | Hahn | 24/712.6 |
| 1,856,696 | A | * | 5/1932 | Domkee | 24/200 |
| 1,879,475 | A | * | 9/1932 | Poon | 24/712.9 |
| 2,309,315 | A | * | 1/1943 | Hirsch | 24/30.5 R |
| 2,650,399 | A | | 9/1953 | Torelli | |
| 3,066,370 | A | | 12/1962 | Epstein | |
| 3,500,508 | A | | 3/1970 | Bennett | |
| 4,290,172 | A | | 9/1981 | Burton | |
| 4,879,787 | A | | 11/1989 | Walls | |
| 5,065,482 | A | | 11/1991 | Lofy | |
| 5,119,539 | A | | 6/1992 | Curry | |
| 5,979,028 | A | | 11/1999 | Hicks et al. | |

* cited by examiner

*Primary Examiner*—Robert J. Sandy
(74) *Attorney, Agent, or Firm*—Ann W. Speckman; Victor N. King; Speckman Law Group PLLC

(57) ABSTRACT

A device for securing and adjusting laces, including any types of cord or string, of a wide variety of articles. The device comprises a body, a top surface, a bottom surface, and a perimeter. The top surface and the bottom surface of the device may be separated by a constant or a variable depth. The body of the device is provided with at least two "lateral" apertures positioned laterally on opposite sides of a center on the body. The body is further provided with at least one "central" aperture positioned between the lateral apertures, and preferably near the center of the body.

19 Claims, 7 Drawing Sheets

LACE SECURING AND ADJUSTING DEVICE

FIELD OF THE INVENTION

The present invention relates to a fastening device and particularly to a device for securing and adjusting laces used in connection with a wide variety of articles. The device enables laces to be conveniently tightened and loosened.

BACKGROUND OF THE INVENTION

Laces, including any types of cord or string, are widely used to secure and fasten a wide variety of articles such as footwear, clothing, bags, and the like. Laces are used to adjustably secure footwear on one's foot, generally via a bow or "butterfly" knot. Laces are also often used as a drawstring to tighten articles of clothing and bags, for example, at the waist of a jacket, a pair of pants, the opening of a hood, or a tent bag, etc., by fastening or tying the ends of the laces together to hold the articles of clothing or bags in place.

However, keeping laces tight and tied is a troublesome and time-consuming process. It is often difficult to achieve proper tension of the tied laces. For example, in order to tie a bow or "butterfly" knot, a person who is tying the knot needs to briefly relax the tension on the laces before pulling them tight to tie the knot. This brief relaxing of the laces' tension provides an opportunity for the laces to loosen up or slip before the knot tying is complete. Also, small children are often unable to properly tie a "butterfly" knot or tie such a knot with sufficient force to prevent it from untying. Similarly, adults who participate in athletic games and events are often interrupted because they need to stop and re-tie or tighten the laces on their shoes. Additionally, laces or drawstrings used on clothing and bags, even tied in a knot, often become loosened and need to be retightened.

Furthermore, when laces are tied in a knot, the action of loosening and tightening the laces is problematic. In order to adjust the tightness of the tied laces, the tied knot needs to be first untied and then retied to achieve the desired tightness, an action that is quite time consuming and inconvenient.

Many devices have been designed to help prevent the loosening and/or untying of laces on footwear. For example: Osterholt, U.S. Pat. No. 1,531,410, discloses diagonally disposed and angled vertical openings on a device to receive the terminal ends of a shoe lace to be tied into a bow; Hahn, U.S. Pat. No. 1,806,162, discloses a device having clamping slits which are narrower than the thickness of the lace and opening at an angle for leading the lace ends; Torelli, U.S. Pat. No. 2,650,399, and Burton, U.S. Pat. No. 4,290,172, use holes on a device that allows a bow knot to be tied; Epstein, U.S. Pat. No. 3,066,370, is similar and suggests multiple holes; Bennett, U.S. Pat. No. 3,500,508, and Lofy, U.S. Pat. No. 5,065,482, use complex tying arrangements and devices to avoid loosening of laces; Walls, U.S. Pat. No. 4,879,787, discloses a device that is used for locking bow knots in place; Curry, U.S. Pat. No. 5,119,539, shows disk-form fasteners having spaced-apart holes with cuts or slots connecting with the holes for capturing the lace ends, avoiding the need then to tie the lace ends with any knot; and Hicks, U.S. Pat. No. 5,979,028, discloses a clip through which the lace ends are threaded and clamped.

The aforementioned inventions mostly involve devices that secure and tighten laces for footwear. These devices require complex looping and arrangements of laces and generally do not allow the tension of the laces to be easily adjusted. Also, most of the aforementioned devices require the tying of a conventional bow or "butterfly" knot to secure the lace on the articles. Furthermore, these devices generally are limited to the tightening of laces on footwear only.

It would therefore be desirable to provide a simple device that secures and adjusts laces not only for footwear, but also for other applications, such as clothing and bags. It would also be desirable to provide a device that would allow laces to be easily secured and tightened without any complex lace looping or arrangements and the need for the tying of a bow or "butterfly" knot to secure the lace, while allowing the device to provide a fast and easy way to adjust the tension of any tied laces.

SUMMARY OF THE INVENTION

The present invention therefore provides a device for securing and adjusting laces, including any types of cord or string, of a wide variety of articles. The device, which may be constructed in a variety of sizes and materials, comprises a body, a top surface, a bottom surface, and a perimeter. The top surface and the bottom surface of the device, which may be planar or flat, are separated by a constant or a variable depth. The body of the device is provided with at least two "lateral" apertures positioned laterally on opposite sides of a center of the body. The body is further provided with at least one "central" aperture positioned between the lateral apertures, and preferably near the center of the body.

In one embodiment, the central aperture has at least four sides and has the shape of a diamond. The angles opposite each other and nearest the lateral apertures may measure within a range from 5° to 110°, and are preferably congruent. These angles form operative wedges that contact portions of the laces. Similarly, the remaining angles are also preferably congruent. In another embodiment, the central aperture of the device may comprise two triangular-shaped apertures. These triangular-shaped apertures are arranged so that a wedge formed by an angle measuring within a range from 5° to 110° faces each lateral aperture. In yet another embodiment, the central aperture of the device may comprise two cone-shaped apertures. Like the triangular-shaped aperture in the above-mentioned embodiment, these cone-shaped apertures are also arranged so that a wedge formed by an angle measuring within a range from 5° to 110° faces each lateral aperture.

The two lateral apertures and the central aperture positioned near the center of the body preferably form an axis that may be positioned variably between the top edge and the bottom edge of the body of the device.

The central aperture positioned near the center of the body further comprises an inner wall extending between the top and bottom surfaces. The inner wall may be perpendicular to the top and bottom surfaces of the device. The inner wall may also form an acute or obtuse angle with the top and/or bottom surfaces of the device.

BRIEF DESCRIPTION OF THE DRAWINGS

The present invention will be described in greater detail in the following detailed description, with reference to the accompanying drawings, wherein.

DETAILED DESCRIPTION OF THE INVENTION

The lace securing and adjusting device may be constructed in a variety of different embodiments and, similarly, may be employed in connection with a wide variety of different articles. As will be described in greater detail below, the lace securing and adjusting device is an extremely simple and inexpensive device that allows laces to be easily and conveniently secured and adjusted. This device is useful in connection with securing laces on footwear, laces and cords used in connection with sporting goods, such as on clothing, bags, and other fastenable cords. Although several specific embodiments are described, it will be apparent that the invention is not limited to the embodiments illustrated, and that additional embodiments may also be used.

The lace securing and adjusting device preferably has the approximate dimensions of one inch by one half inch, but it may be constructed in a variety of different sizes. The device may also be manufactured in a variety of rigid or non-rigid materials, such as plastic or thermoplastic, that have sufficient integrity and strength to withhold the lace tension applied to the device.

Figure 1A:
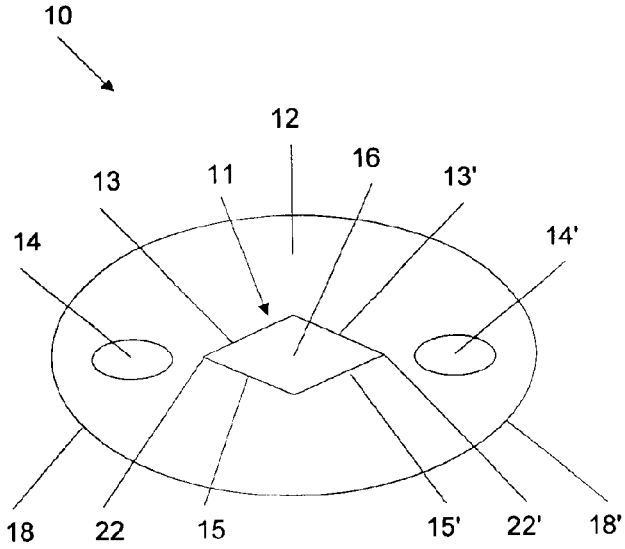
FIGS. 1*a*–1*d* show the top view of four different embodiments of a device of the present invention for securing and adjusting laces, each figure showing different configurations of lateral apertures.

One embodiment of a lace securing and adjusting device 10, shown in FIG. 1*a*, includes a body 12 having a generally oval or oblong perimeter. Other suitable perimeter configurations of body 12, such as rectangular, trapezoidal, circular, polygonal, irregular curve-shaped, and the like may be used, as desired, since the perimeter configuration of body 12 is not crucial to the operation of the present invention.

Body 12 is provided with a pair of "lateral" apertures 14, 14', preferably having the same sizes and configurations, which, together, form a longitudinal axis. The apertures 14, 14' are positioned laterally on opposite sides of a center 16 of the device 10, and in one embodiment, both apertures 14, 14' are positioned at equal distances from the edges 18, 18' where the longitudinal axis intersects the device perimeter.

Figure 1B:
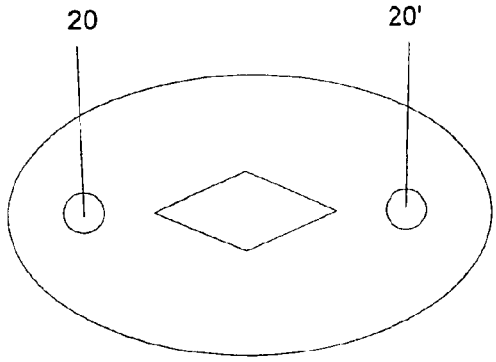
Figure 1C:
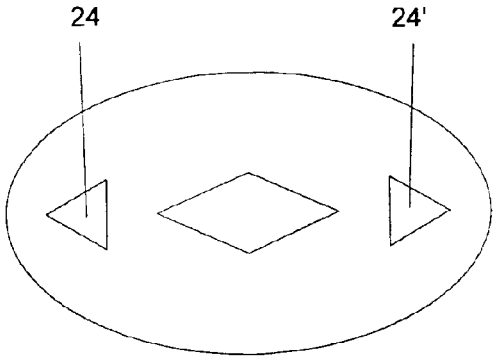
Figure 1D:
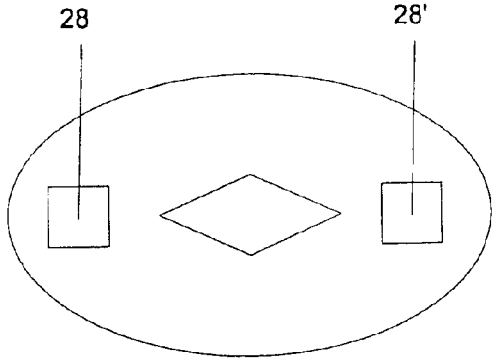

The apertures 14, 14' may be generally circular in shape. However, any sizes or configurations of apertures 14, 14' that allow laces to be extended through at least twice can be utilized for the present invention, as shown in different embodiments of the device in FIGS. 1*a*–1*d*. FIG. 1*a* shows an embodiment of the device having two horizontally oriented oval-shaped apertures 14, 14', arranged laterally and symmetrically with respect to center 16; FIG. 1*b* shows another embodiment of the device having two circular lateral apertures 20, 20'; FIG. 1*c* shows a further embodiment of the device having two triangular-shaped lateral apertures 24, 24'; FIG. 1*d* shows yet another embodiment of the device having two squared-shaped lateral apertures 28, 28'.

Figure 2A:
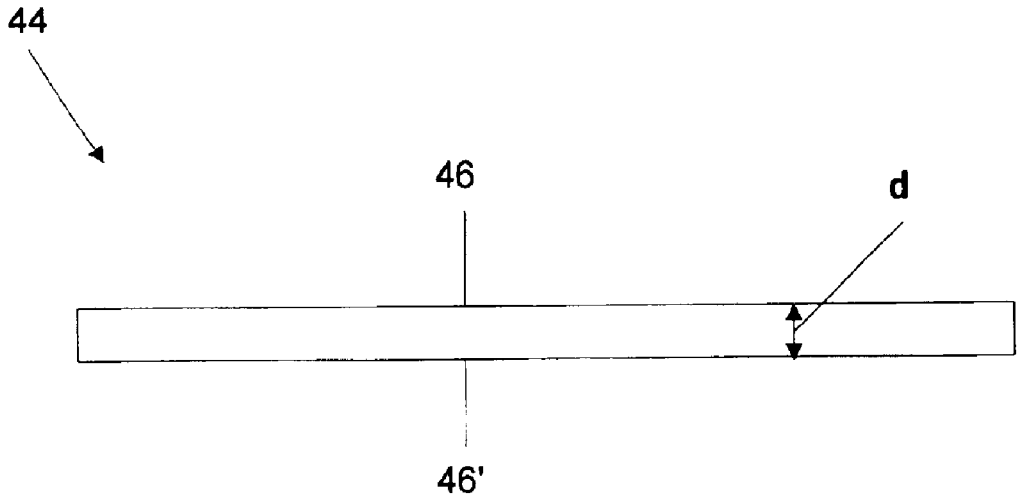
FIGS. 2*a* and 2*b* show the side view of two different embodiments the device, each figure showing the device having different depth.
Figure 2B:
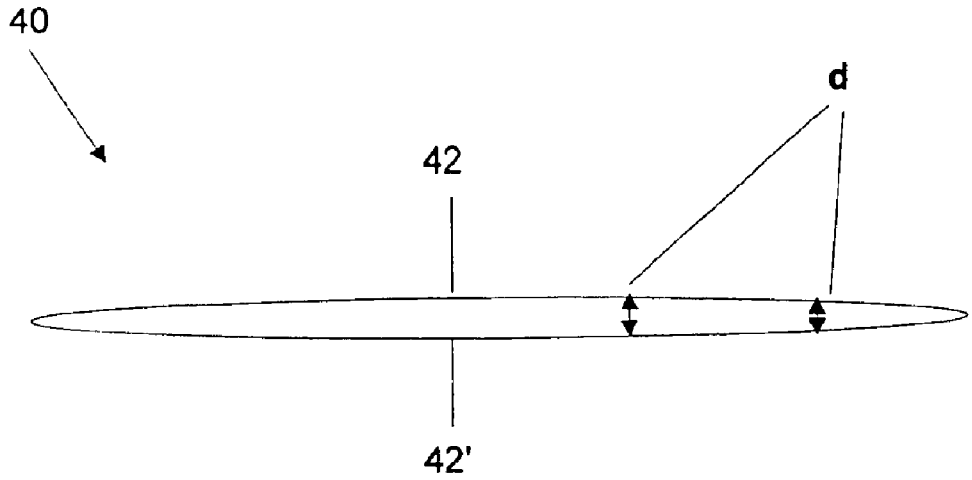

In some embodiments, one of which is shown in FIG. 2*a*, body 44 has a top surface 46 and a bottom surface 46' that are planar and substantially parallel to one another. In this embodiment, body 44 has a substantially constant depth d. In another embodiment, shown in FIG. 2*b*, the top surface 42 and bottom surface 42' may not form planar surfaces. In this embodiment, body 40 has a variable depth d. In other embodiments, both the top surface and bottom surface of the device may be planar or curved, or at least one of the top or bottom surfaces may be planar while the other surface is curved.

As illustrated in FIG. 1*a*, near the center 16 of the device 10, there is a "central" aperture 1, which may be in the shape of diamond. The central aperture 11 may be aligned on an axis with lateral apertures 14, 14'. The central aperture 11 is defined by four sides 13, 13', 15, 15'. A "wedge" angle 22 is formed by the interface of sides 13, 15. Similarly, "wedge" angle 22' is formed by the interface of sides 13', 15'. The wedge angles 22, 22' face lateral apertures 14, 14' and measure between the range of 5° and 110°, preferably less than 95° and more than 10°. In many applications, wedge angles 22, 22' measuring between 20° and 60° are preferred, while wedge angles 22, 22' measuring between 30° and 45° are preferred for some other applications.

Figure 3A:
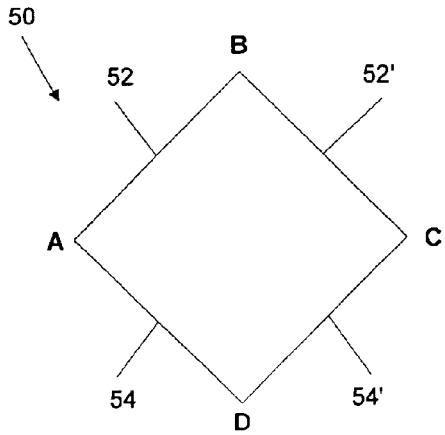
FIGS. 3*a*–3*e* show the top view of five different embodiments of a diamond-shaped central aperture, positioned near the center of the device, each figure showing different configurations of the central aperture.

Different embodiments of the central aperture are shown in FIGS. 3*a*–3*e*. In FIG. 3*a*, an embodiment of central aperture 50, positioned near the center of the device in the shape of a diamond is shown. In this embodiment, central aperture 50 has four sides 52, 52', 54, 54', four corners A, B, C, D, and two congruent wedge angles A, C at 90° that are opposite each other. Each side of central aperture 50 can be defined as a segment beginning at one corner and ending at another corner. For example, the side 52 positioned between corner A and corner B is defined as segment AB, and the side 54' positioned between corner C and corner D is defined as segment CD. For the purpose of identification, segment CD represents the same segment as segment DC. In this embodiment, the top two sides 52, 52', or segments AB and BC of central aperture 50 must be of equal length or congruent to each other, and the bottom two sides 54, 54', or segments AD and CD must also be of equal length or congruent to each other. Wedge angle A is congruent to wedge angle C. The congruency of wedge angles A and C ensures that equal tension is applied to wedge corners A and C when laces are extended through the diamond-shaped central aperture 50.

Figure 3B:
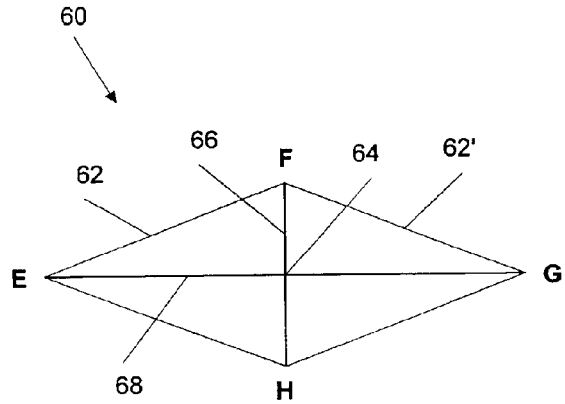

FIG. 3*b* shows another embodiment of central aperture 60 with two wedge angles E, G measuring less than 90°, opposite to each other. In this embodiment, central aperture 60 can be defined by two triangles FGH, FEH or two wedges 62, 62'. Central aperture 60 comprises two wedges 62, 62', as shown in FIG. 3*b*, which are separated from each other within central aperture 60 by a vertical axis 66 running from corner F to corner H. Vertical axis 66 intersects a horizontal axis 68, running from corner E to corner G, at a center 64 of central aperture 60, forming a 90° angle. The two wedges 62, 62' are positioned in a manner where corners E and G point towards opposite directions along horizontal axis 68, and faces lateral apertures 14, 14' on the device 10. The wedges 62, 62' further relate to each other in the following manner: segment EF of wedge 62 intersects segment FG of wedge 62' at top corner F; and segment EH of wedge 62 intersects segment HG of wedge 62' at bottom corner H.

Figure 3C:
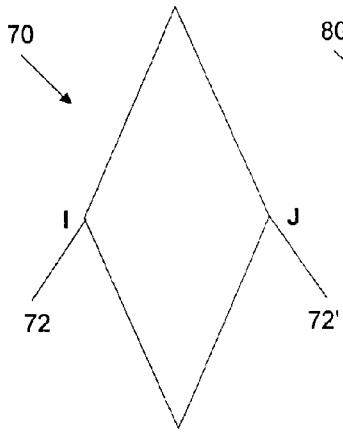

FIG. 3*c* shows a further embodiment of central aperture 70 with two wedge angles I, J, measuring more than 90°, opposite to each other. In this embodiment, corners I and J of central aperture 70 form wedge angles 72, 72' that are congruent to each other.

As shown in FIGS. 3*a*–3*c*, wedge angles at corners A, C, corners E, G, and corners I, J of the central aperture may form various angles. In a preferred embodiment shown in FIG. 3*b*, wedge angles E, G, of about 35°, provide a good "wedged" effect to secure and tighten laces that are extended through central aperture 60. However, the diamond-shaped central aperture is still able to provide an operational "wedged" effect as long as the wedge angles measure within the range of 5° to 110°.

Figure 3D:
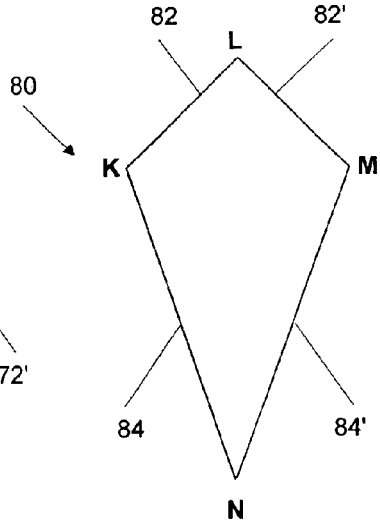
Figure 3E:
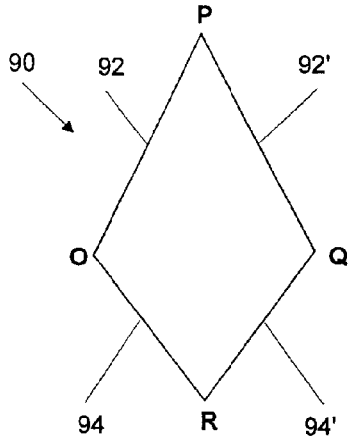

In FIGS. 3*d* and 3*e*, two different embodiments of central apertures 80, 90 are shown. FIG. 3*d* shows an embodiment of central aperture 80 in the shape of a quadrilateral, with top two sides 82, 82', having the same length, being shorter in length than bottom two sides 84, 84', which are equal in length to each other. Wedge angles K and M of central aperture 80, facing the lateral apertures on the device, are congruent to each other, while angles L and N are non-congruent to each other.

FIG. 3*e* shows yet another embodiment of central aperture 90 in the shape of a quadrilateral, with top two sides 92, 92', having the same length, being longer in length than bottom two sides 94, 94', which are equal in length to each other. Like the embodiment shown in FIG. 3*d*, wedge angles O and Q, facing lateral apertures on the device, are congruent to each other, while angles P and R are non-congruent to each other.

Figure 4A:
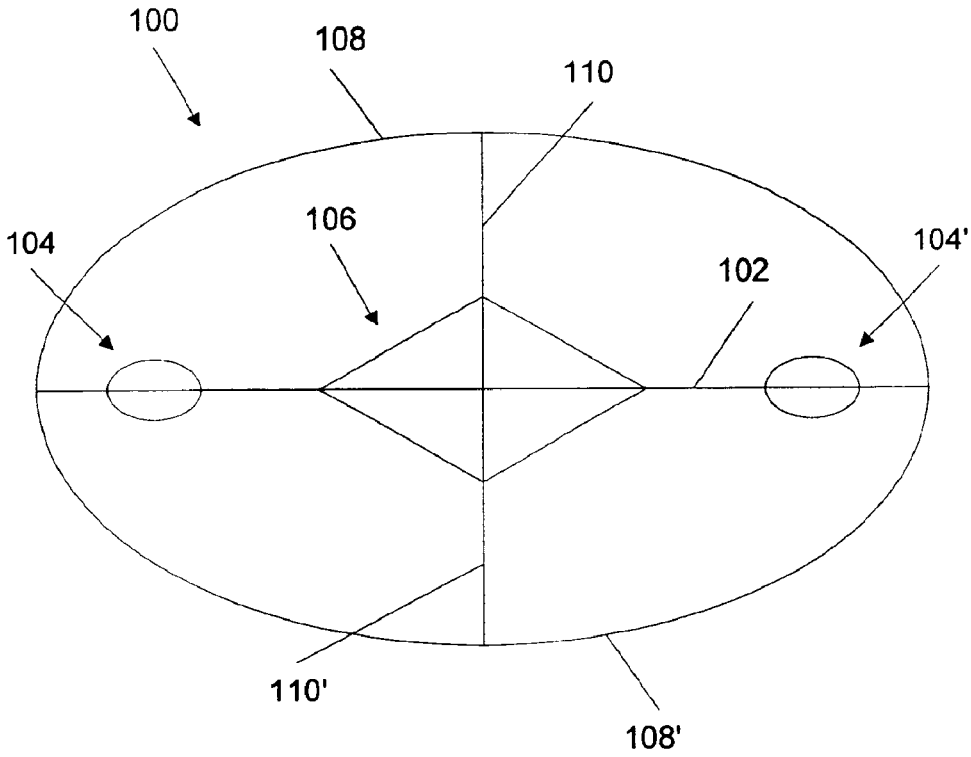
FIGS. 4*a* and 4*b* show the top view of two different embodiments of the device, each figure showing the device's axis passing through the lateral and central apertures being at a different distance from the top and bottom edges of the device.
Figure 4B:
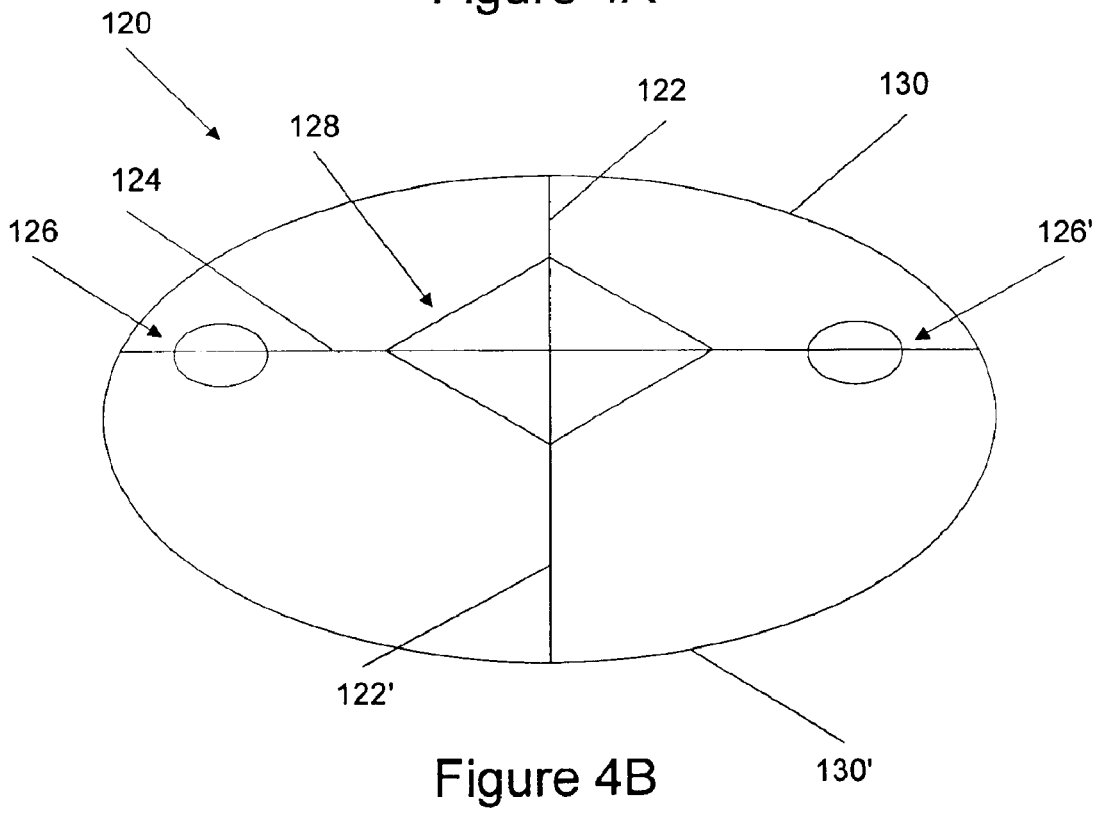

FIG. 4*a* shows the top view of an embodiment of the device 100, where an axis 102 passes through lateral apertures 104, 104' and central aperture 106 is at the same distance from a first edge 108 and from a second edge 108' of the device 100. However, the distance between axis 102 measured from first edge 108 and second edge 108' of the device 100 can be varied. As shown in FIG. 4*a*, the length of a vertical segment 110 measured from axis 102 to first edge 108 is the same as the length of a vertical segment 110' measured from axis 102 to second edge 108' of the device 100. In contrast, as shown in FIG. 4*b*, the length of vertical segment 122 measured from axis 124 that passes through lateral apertures 126, 126' and central aperture 128 to first edge 130 of the device 120 is shorter than the length of vertical segment 122' measured from axis 124 to second edge 130' of the device 120.

Figure 5A:
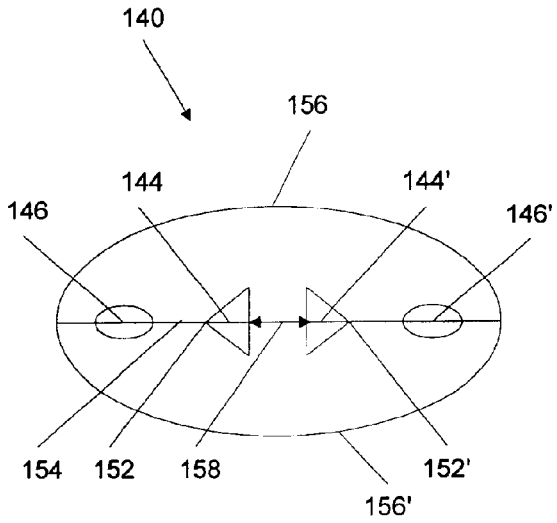
FIGS. 5*a* and 5*b* show the top view of two further different embodiments of the device, each figure showing the central aperture comprising two wedges.

In FIG. 5*a*, the top view of another embodiment of the device 140 of the present invention is shown. The central aperture, unlike the aforementioned embodiments, is not in the shape of a diamond. Rather, the central aperture comprises two separate apertures 144, 144', which are roughly the same size as lateral apertures 146, 146'. Apertures 144, 144', in the embodiment shown in FIG. 5*a*, are triangular-shaped and arranged in a manner so that wedges are formed by angles 152, 152' measuring within a range from 5° to 110° that face each lateral aperture 146, 146'. The two triangular-shaped central apertures 144, 144', together with the two lateral apertures 146, 146' form a longitudinal axis 154. Like the embodiments shown in FIGS. 4*a* and 4*b*, the distance between longitudinal axis 154 measured from first edge 156 and second edge 156' of the device 140 can be varied. The distance 158 between the two triangular-shaped central apertures 144, 144' can also be varied, so long there is enough separation between triangular-shaped central apertures 144, 144' and lateral apertures 146, 146' to provide adequate tension to secure laces.

Figure 5B:
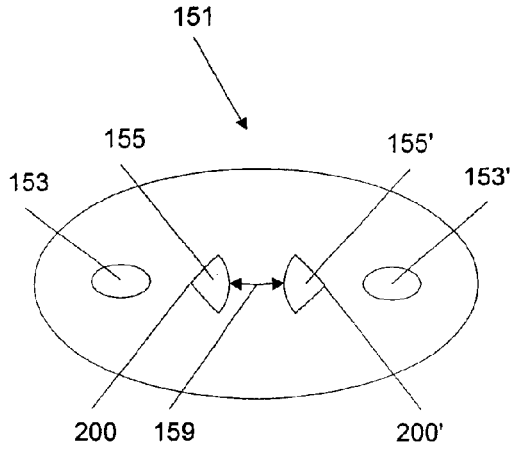

In FIG. 5*b*, the top view of still another embodiment of the device 151 of the present invention is shown. The central aperture comprises two separate apertures 155, 155', which are cone-shaped and arranged in a manner so that wedges are formed by angles 200, 200' measuring within a range from 5° to 110° that face each lateral aperture 153, 153'. Like the embodiment shown in FIG. 5*a*, the distance 159 between the two cone-shaped central apertures 155, 155' can also be varied.

Figure 6:
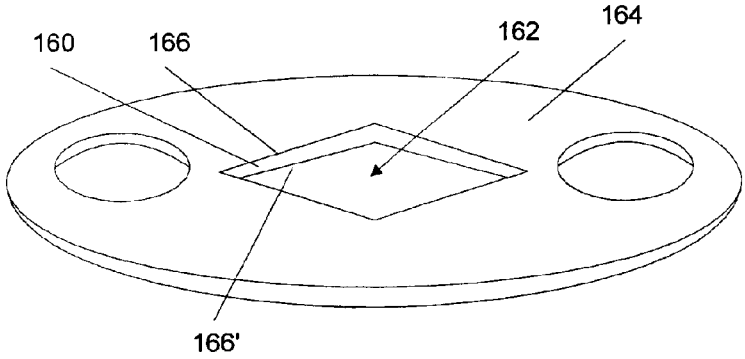
FIG. 6 is a three-dimensional perspective view of the device, showing the inner walls extending between the top and bottom surfaces of the device.

FIG. 6 shows a three-dimensional perspective view of the device of the present invention. In one embodiment of the device shown in FIG. 6, the inner wall 160 of the central aperture 162 is perpendicular to, or forms a 90° angle with the surface 164 of the body of the device. In another embodiment, the inner wall 160 of central aperture 162 is tapered in a manner in which the bottom part 166 of the inner wall 160 is smaller than the top part 166' of the inner wall 160. In other words, the inner wall 160 forms an acute angle with the surface 164 of the body of the device. In a further embodiment, the inner wall 160 of central aperture 162 is tapered in a manner in which the top part 166' is smaller than the bottom part 166 of the inner wall 160 of central aperture 162; the inner wall 160 forms an obtuse angle with the surface 164 of the body of the device. The advantage in both tapered-inner wall embodiments is that a tapered wall may provide a more efficient "wedged" effect to better secure the laces of the articles when the device of the present invention is installed.

Figure 7:
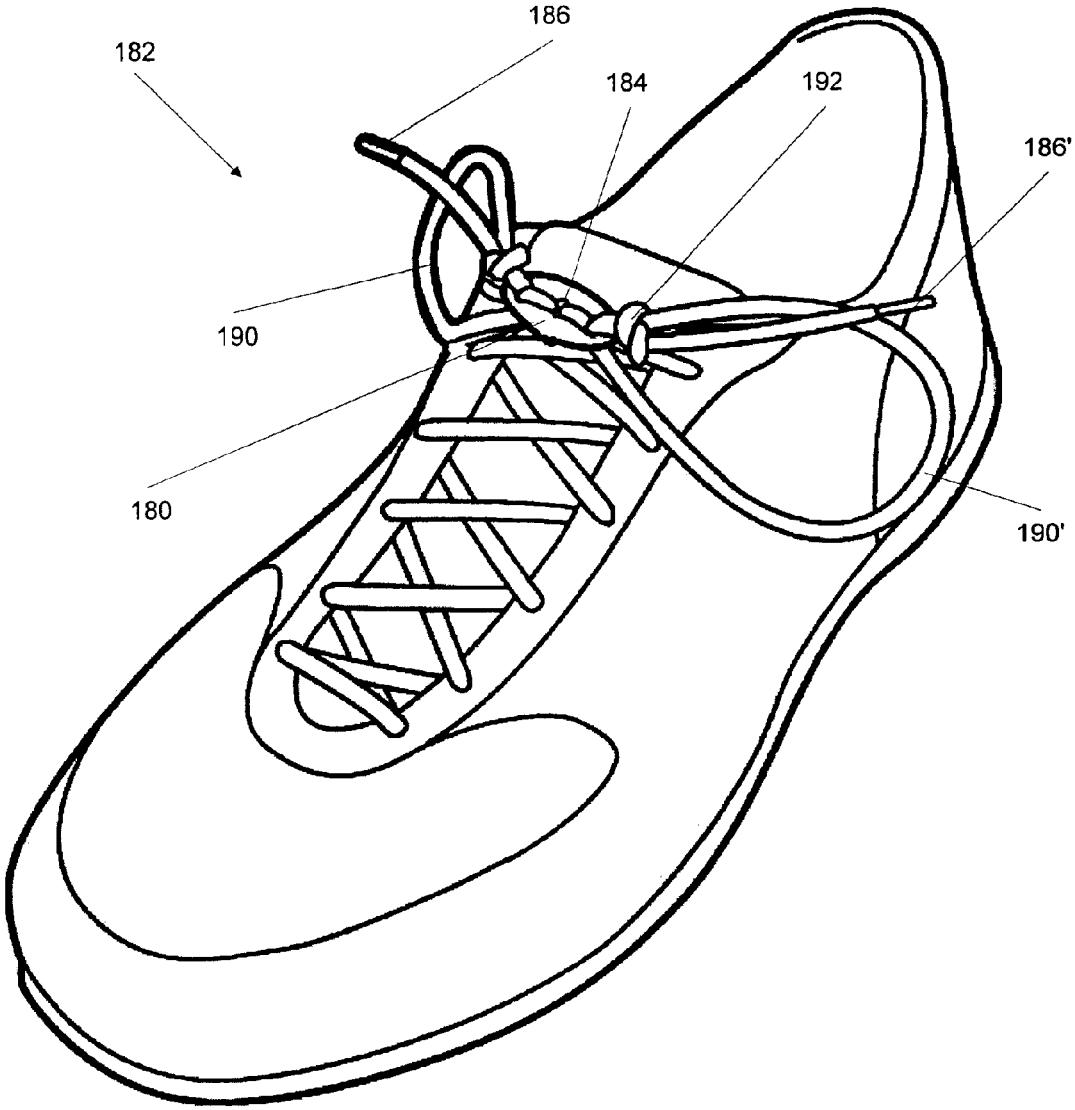
FIG. 7 is a perspective view of a shoe with the device installed on the shoe laces.
Figure 8:
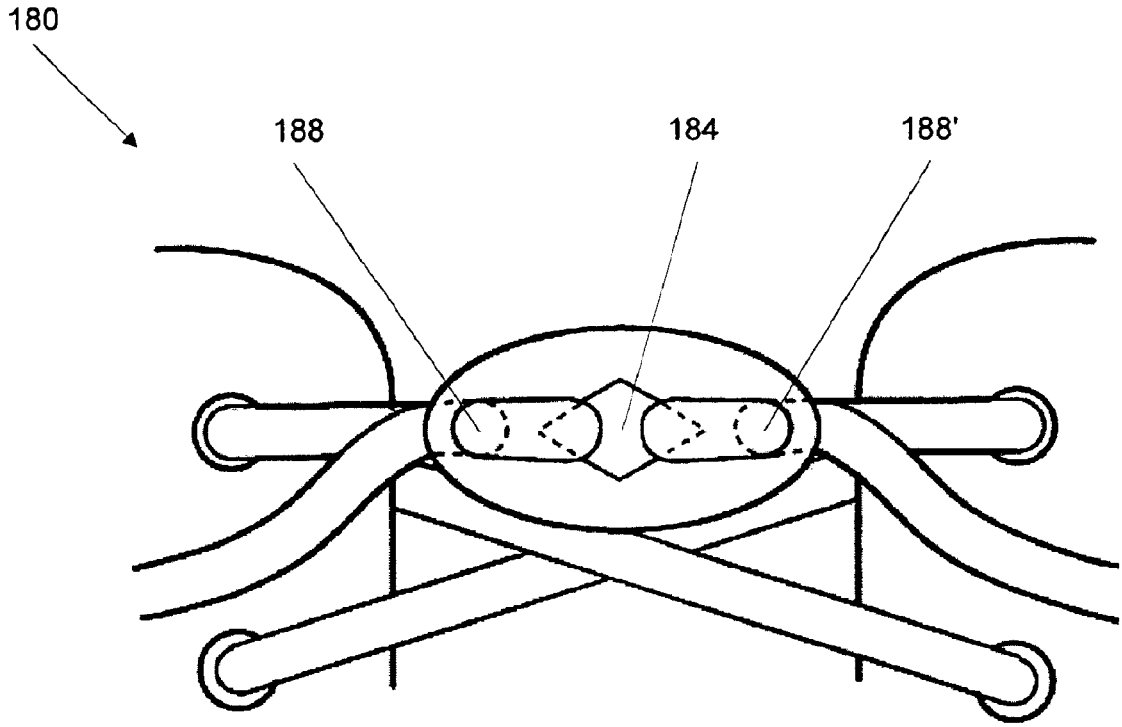
FIG. 8 shows a top view of the device in a static position with laces secured by the device, with broken lines showing the openings underlying the laces.

In FIG. 7, the device 180 of the present invention is shown installed and fixed on a shoe 182. In FIG. 8, the device 180 is shown in a locked position with laces extended through the apertures. The lace to be extended through the device 180 is first extended through the central aperture 184. This first step is achieved by passing the central aperture 184 of the device 180 downward through the two ends of the laces 186, 186'. Both the extended ends 186, 186' of the laces are then each passed downward, from the upper side of the device 180, through the two lateral apertures 188, 188', where temporary loops are formed above the upper surface of the device 180. Next, both ends 186, 186' of the laces are pulled horizontally in an outward direction from the bottom side of the device 180. Then, both ends 186, 186' of the laces are again extended upward from the bottom side of the device 180 through the two lateral apertures 188, 188', forming another set of loops 190, 190'. With the ends 186, 186' of the laces extending through the two lateral apertures 188, 188', a knot 192 is tied with each end of the lace through the loops 190, 190'.

The action of securing or tightening of the laces installed with the device of the present invention is achieved by pulling both loops 190, 190' in a downward direction. The upward pulling action on the loops 190, 190' induces the device to move downward towards the article to be tightened, therefore securing and tightening the laces. The loosening of the laces is achieved by pulling on both exposed ends 186, 186' of the laces in an upward direction. The pulling of the ends 186, 186' of the laces causes the device to move upwards, away from the articled that was tightened, therefore loosening the laces. The device of the present invention can thus be easily adjusted, by pulling on both loops 190, 190' or both the exposed ends of the laces 186, 186', to accommodate any desired tightness or pressure to be applied to the article installed with the device.

I claim:

1. A device for securing and adjusting laces, cords, and strings, comprising:

a body having a top surface, a bottom surface, and a perimeter, said body provided with at least two apertures positioned laterally on opposite sides of a center of said body, said body further being provided with at least one aperture positioned near the center of said body, said at least one central aperture comprising at least four sides and forming at least two wedge angles facing each lateral aperture, wherein a longitudinal axis is formed through geometric centers of said at least two lateral apertures and said at least one central aperture.

2. The device according to claim 1, wherein the configuration of said perimeter is selected from the group consisting of: oval, rectangular, trapezoidal, circular, polygonal, and irregular curve-shape.

3. The device according to claim 1, wherein said central aperture further comprises an inner wall that forms an acute angle with one of said top or bottom surfaces.

4. The device according to claim 1, wherein the configuration of said lateral apertures is selected from the group consisting of: oval, circular, triangular, square, and rectangular.

5. The device according to claim 1, wherein said top surface and said bottom surface are separated by a constant depth.

6. The device according to claim 1, wherein said top surface and said bottom surface are separated by a variable depth.

7. The device according to claim 1, wherein said central aperture comprises four sides of equal length forming the shape of a diamond.

8. The device according to claim 7, wherein said central aperture further comprises:

(a) two congruent wedge angles opposite each other on a horizontal axis; and (b) two congruent angles opposite each other on a vertical axis.

9. The device according to claim 8, wherein said congruent wedge angles are from 5° to 110°.

10. The device according to claim 8, wherein said congruent wedge angles are more than 10° and less than 95°.

11. The device according to claim 8, wherein said congruent wedge angles are more than 15° and less than 80°.

12. The device according to claim 8, wherein said congruent wedge angles are from 200 to 60°.

13. The device according to claim 1, wherein said central aperture further comprises an inner wall that is perpendicular to said top or bottom surfaces.

14. The device according to claim 1, wherein said longitudinal axis is positioned at a same distance from a first edge and a second edge of said body.

15. The device according to claim 1, wherein said longitudinal axis is positioned at a different distance from said first edge and said second edge of said body.

16. A device for securing and adjusting laces, cords, and strings, comprising:

a body having a top surface, a bottom surface, and a perimeter, said body provided with at least two apertures positioned laterally on opposite sides of a center of said body and said body further being provided with at least two triangular-shaped central apertures positioned near the center of said body.

17. The device according to claim 16, wherein said triangular-shaped central apertures comprise congruent wedge angles measuring within a range from 5° to 110°.

18. A device for securing and adjusting laces, cords, and strings, comprising:

a body having a top surface, a bottom surface, and a perimeter, said body provided with at least two apertures positioned laterally on opposite sides of a center of said body, said body further being provided with at least one aperture positioned near the center of said body, said at least one central aperture comprising at least four sides and forming at least two wedge angles facing each lateral aperture, wherein said at least one central aperture further comprises:

(a) four sides having unequal lengths forming the shape of a quadrilateral;

(b) two congruent wedge angles opposite each other on a horizontal axis; and (c) two non-congruent angles opposite each other on a vertical axis.

19. A device for securing and adjusting laces, cords, and strings, comprising: a body having a top surface, a bottom surface, and a perimeter, said body provided with at least two apertures positioned laterally on opposite sides of a center of said body, and said body further being provided with at least two triangular-shaped central apertures positioned near the center of said body.

* * * * *